United States Patent [19]

Hartmann et al.

[11] Patent Number: 4,569,545

[45] Date of Patent: Feb. 11, 1986

[54] LAMINATED HASP

[75] Inventors: Udo Hartmann, Mequon; Mark W. Stoller, Milwaukee; Kenneth N. Grandy, South Milwaukee, all of Wis.

[73] Assignee: Master Lock Company, Milwaukee, Wis.

[21] Appl. No.: 522,324

[22] Filed: Aug. 11, 1983

[51] Int. Cl.[4] ..... E05C 19/08

[52] U.S. Cl. ..... 292/281; 70/2

[58] Field of Search ..... 70/2–13, 70/52; 292/281–287

[56] References Cited

U.S. PATENT DOCUMENTS

| | | | |
|---|---|---|---|
| 574,276 | 12/1896 | Schlichting | 292/285 |
| 3,787,082 | 1/1974 | Foote | 292/281 |
| 4,371,202 | 2/1983 | Freeman et al. | 403/79 X |

FOREIGN PATENT DOCUMENTS

| | | | |
|---|---|---|---|
| 17015 | of 1928 | Australia | 292/281 |
| 606962 | 12/1934 | Fed. Rep. of Germany | 70/52 |
| 41350 | 7/1968 | Finland | 292/281 |
| 470216 | 3/1952 | Italy | 292/281 |
| 5663 | 3/1894 | Sweden | 292/281 |
| 126760 | 7/1928 | Switzerland | 292/281 |

*Primary Examiner*—Kenneth J. Dorner
*Assistant Examiner*—Lloyd A. Gall
*Attorney, Agent, or Firm*—Pennie & Edmonds

[57] ABSTRACT

A laminated hinged hasp arrangement for use in securing together elements adjacent one another with varying orientations to one another. Sections of the hasp include laminate plates of varying sizes and pins and rivets aligning and securing such plates together.

4 Claims, 8 Drawing Figures

LAMINATED HASP

BACKGROUND OF THE INVENTION

Numerous arrangements for providing hasps and other hardware for utilizing shackle locks, such as padlocks, have been proposed. Prior arrangements have lacked security and versatility while the present invention has the security that laminated construction affords and further has versatility to secure a variety of surfaces disposed at angles or offset from one another.

SUMMARY OF THE INVENTION

In summary, this invention comprises a hasp arrangement for locking the elements together using a shackle lock, such as a padlock, which arrangement includes a loop piece secured by fasteners to an element, a base mount secured to another element by fasteners and a first laminated section hingedly connected to the base mount and a second laminated section hingedly connected to the first section. The second section has an opening in it to fit over the loop piece to receive the lock shackle.

It is a feature that each section is composed of a plurality of laminated plates and the sections which, when in locked position, cover the loop piece and base mount to prevent fastener removal.

It is a further feature that additional hinged sections can be added to the hasp arrangement for further versatility.

DESCRIPTION OF THE PREFERRED EMBODIMENT

Figure 1:
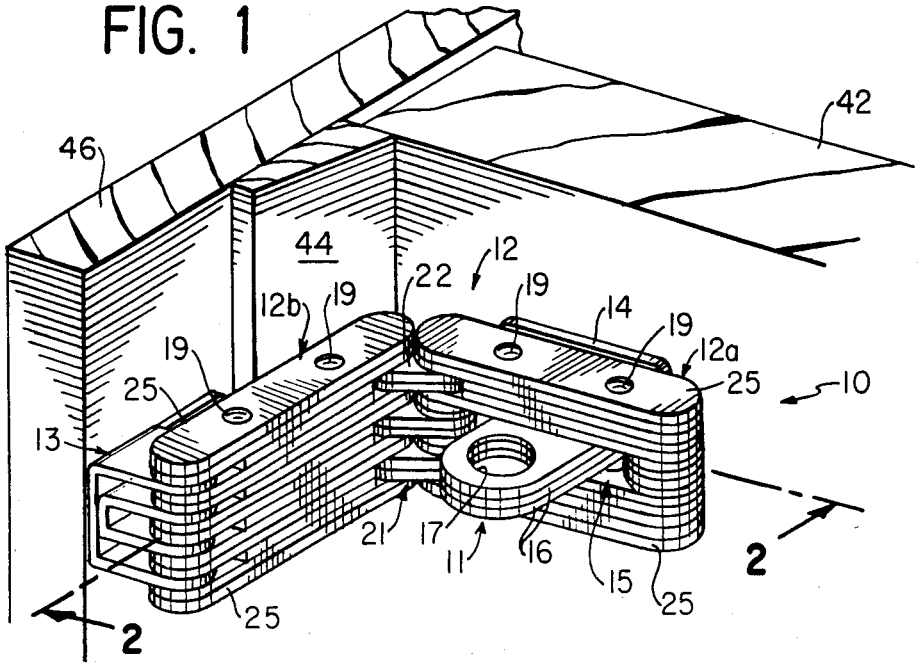
FIG. 1 is a perspective view of the hasp arrangement positioned on an inside corner.
Figure 2:
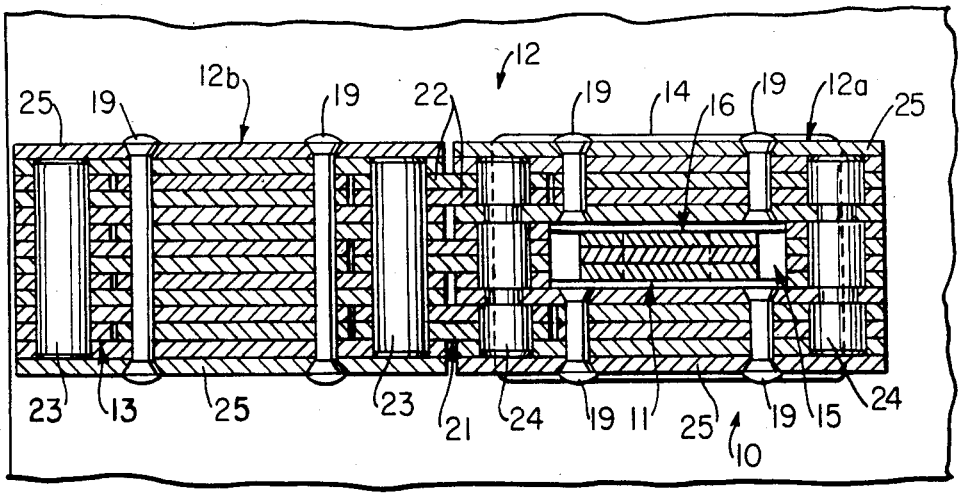
FIG. 2 is a sectional view taken along line 2—2 of FIG. 1.
Figure 3:
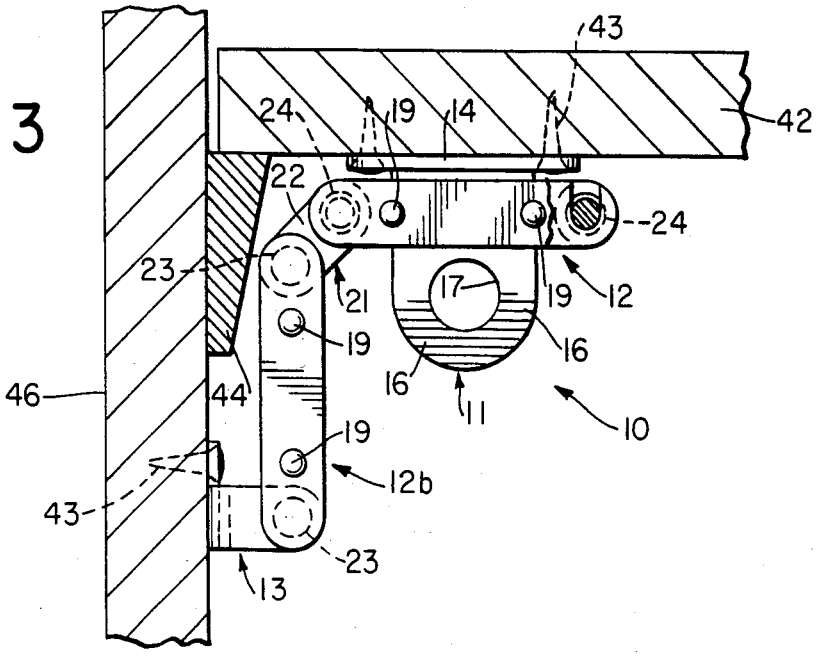
FIG. 3 is a plan view of the hasp arrangement of FIG. 1.

Referring to FIGS. 1, 2 and 3, hasp latch arrangement 10 includes laminate loop piece 11, laminated multi-sectioned hinged latch arm 12 and arm base mount 13.

Loop piece 11 includes loop plate 14, loop laminate plates 16 secured to the loop plate 14 and laminate plates 16 shaped to form lock shackle receiving hole 17. Latch arm 12 comprises laminated arm sections: loop piece receiving section 12*a* having opening 15 therein, and hasp arm base plate section 12*b*. Each arm section 12*a* and 12*b* consists of laminated plates of varying lengths and shapes secured together by long and short rivets 19.

Figure 4:
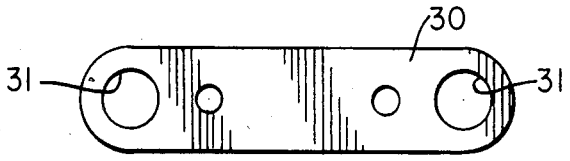
FIG. 4 is a plan view of a laminate plate.
Figure 5:
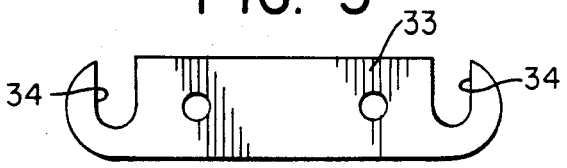
FIG. 5 is a plan view of a grooved laminate plate.
Figure 6:
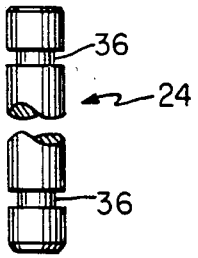
FIG. 6 is an elevational view of a notched pin.

Hinge unit 21 connecting sections 12*a* and 12*b* includes hinge plates 22, cylindrical hinge pin 23, and notched hinge pin 24. Sections 12*a* and 12*b* have outside (upper and lower) laminate plates 25 with holes only for rivets 19. Plates 25 serve to limit the upward and downward movement of cylindrical hinge pins 23, notched hinge pin 24, stationary notched pin 27 of section 12*a* and base mount pin 28 of section 12*b*. In addition, sections 12*a* and 12*b* are made up of section plates 30 (FIG. 4) with holes 31 at their ends for receiving pins 23, 24, 27 and 28; interlocking arm section plates 33 (FIG. 5) with slots 34 for interlocking with grooves 36 in interlocking pins 24, 27; the shorter hinge plates 22 having holes at each end for receiving pins 23 and 24; reduced-length filler plates 37 to accommodate movement of hinge plates 34 and, finally, pin filler plates 38. Reduced-length plates 37 and filler plates 38 are arranged to form opening 15 in section 12*a* and to accommodate proper range and operation of hinge unit 21.

Interlocking pins or cylindrical pins may be used in the arm section 12*a* or 12*b*. Interlocking pins 24 and 27 and interlocking plates 33 are preferred in locations where full length plates are usable and where increased strength and tamper resistance are desired.

Hasp arrangement 10 is mounted with loop plate 14 attached to door 42 using screw fasteners 43. Door 42 rests against door jam 44. Base mount 13 is attached to wall 46 also using screws 43. Door 42 and wall 46 form an inside corner.

Figure 7:
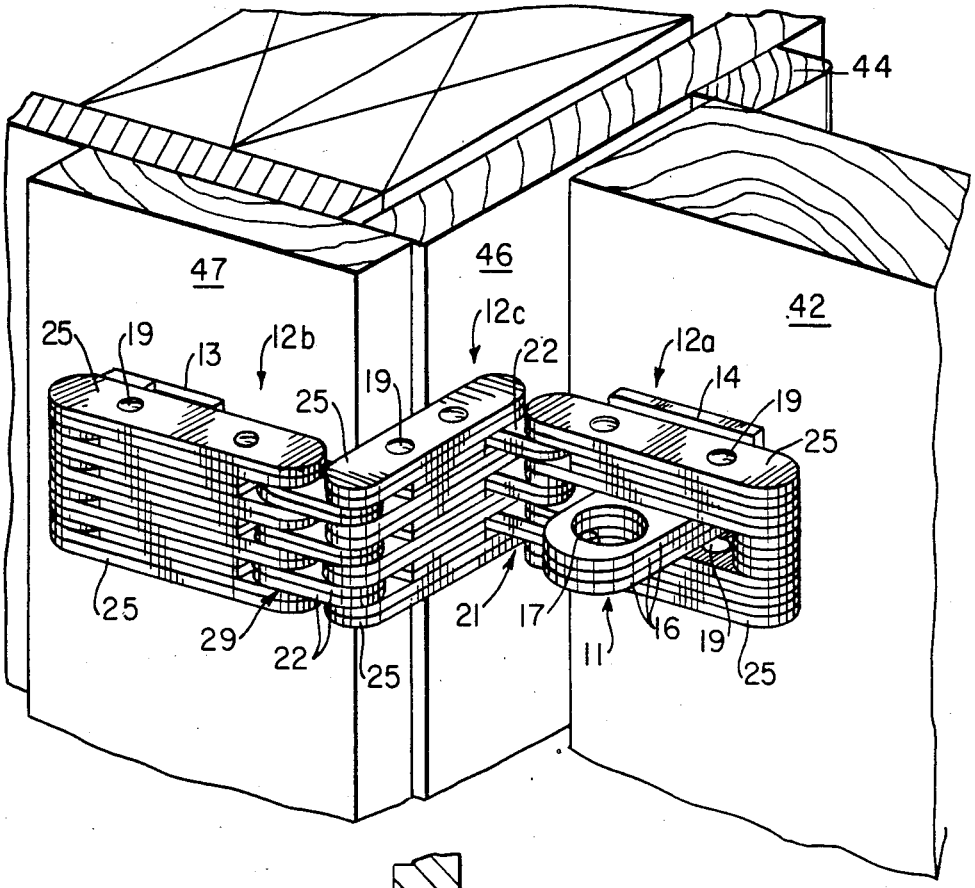
FIG. 7 is a perspective view of another embodiment of the hasp arrangement invention on an outside corner.
Figure 8:
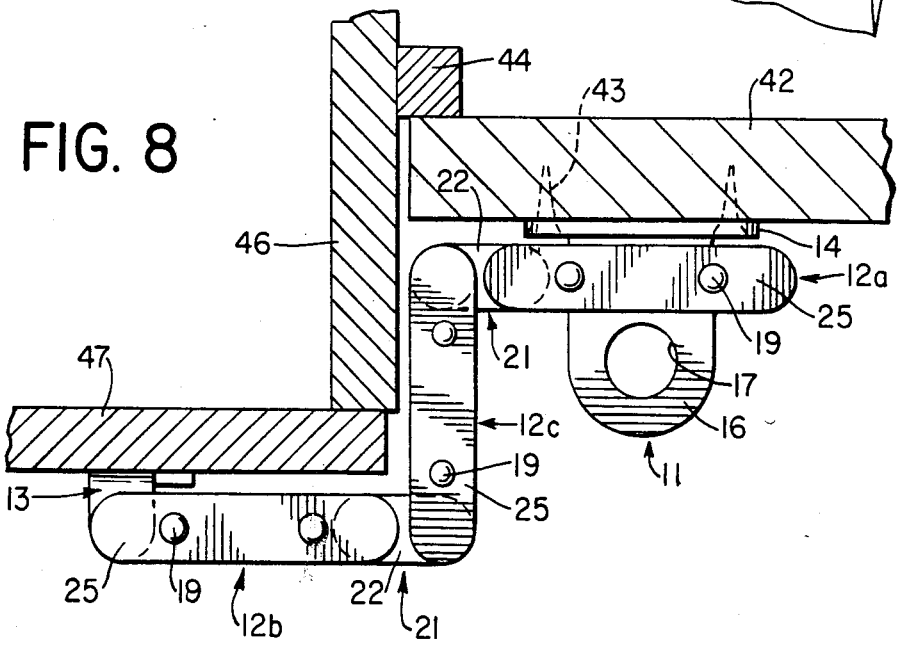
FIG. 8 is a plan view of the hasp arrangement of FIG. 7.

Turning to FIGS. 7 and 8, another embodiment of the invention is shown in which intermediate arm section 12*c* is added to permit base mount 13 to be attached to wall 47 using screws 43. In this embodiment, an additional hinge unit 21 with required hinge plates 22 is employed. Walls 46 and 47 form an outside corner around which the hoop arrangement extends.

I claim:

1. A hasp arrangement for securing through a shackle type lock two elements to be locked together, which elements are positioned adjacent one another in two (2) or more planes comprising a lock shackle receiving loop means constructed of laminate plates including a loop base and first securing means for securing with fasteners said loop means to one of said elements;

a hasp arm base positionable in a plane different from the plane of the loop base;

second securing means for securing the hasp arm base to a second element positioned in a plane different from the first element;

a hasp arm hingedly connected to the hasp arm base, said hasp arm comprising at least two laminated arm sections hingedly engaged including a hasp arm section and a loop arm section, the loop arm section including hinge plates and a loop-receiving opening therein formed in part by an edge of said hinged plates; and wherein the arm sections are positioned at angles to one another to prevent access to the first and second securing means when the loop arm section is positioned so that the loop means is in the loop-receiving opening in locked position.

2. The hasp arrangement of claim 1 in which in addition an intermediate arm section is hingedly connected between the loop arm section and the hasp arm section.

3. The hasp arrangement of claim 1 in which one of the arm sections includes at least one interlocking arm section plate with a slot and an interior interlocking hinge pin with a groove to receive and engage the plate.

4. The hasp arrangement of claim 1 in which one of the arm sections includes an upper plate and a lower plate and pins positioned between such plates wherein the pins are of such length that the plates subtantially limit upward and downward movement of the pins.

* * * * *